United States Patent [19]

Ahlstone

[11] Patent Number: 4,880,061

[45] Date of Patent: Nov. 14, 1989

[54] TOOL FOR RUNNING STRUCTURES IN A WELL

[75] Inventor: Arthur G. Ahlstone, Ventura, Calif.

[73] Assignee: Cameron Iron Works USA, Inc., Houston, Tex.

[21] Appl. No.: 108,377

[22] Filed: Oct. 14, 1987

Related U.S. Application Data

[62] Division of Ser. No. 3,117, Jan. 14, 1987, Pat. No. 4,736,799.

[51] Int. Cl.[4] ..... E21B 23/00; E21B 33/043

[52] U.S. Cl. ..... 166/348; 166/182; 166/208

[58] Field of Search ..... 166/208, 348, 72, 181, 166/182, 125

[56] References Cited

U.S. PATENT DOCUMENTS

| | | | |
|---|---|---|---|
| 3,468,559 | 9/1969 | Ahlstone | 166/348 X |
| 3,809,158 | 5/1974 | Bonds et al. | 166/250 |
| 3,924,678 | 12/1975 | Ahlstone | 166/182 X |
| 4,353,420 | 10/1982 | Miller | 166/182 X |
| 4,488,740 | 12/1984 | Bangh et al. | 285/84 |
| 4,561,499 | 12/1985 | Berner, Jr. et al. | 166/85 |

*Primary Examiner*—Hoang C. Dang

[57] ABSTRACT

A packoff assembly for sealing the annulus between the outside surface of a tubing hanger and the internal bore of a subsea wellhead includes a packoff sleeve insertable in the annulus and a seal assembly on its lower end. A release sleeve is disposed around the upper end of the packoff sleeve and is axially movable with respect thereto. An internal shoulder on the packoff sleeve receives a lock ring on the tubing hanger when the seal assembly is set to lock the packoff assembly to the tubing hanger. Circumferentially spaced apart dogs on the packoff sleeve and radially slidable on the shoulder are forced inwardly by the release sleeve when it is pulled up to retract the lock ring from the shoulder and release the packoff assembly from the tubing hanger. A running tool for running the tubing hanger and packoff assembly into the well and setting the packoff includes telescoping upper and lower body members. A surrounding sleeve is disposed around the lower body member and includes a piston surface for actuating the surrounding sleeve downwardly to set the seal assembly. Releasable latches are carried between the surrounding sleeve and the lower body member for attaching to the packoff assembly and tubing hanger. A hydraulic indicator detects sufficient downward movement of the upper body member to set the seal assembly. Emergency release a shuttle valve connected to a line in the hydraulic system to release the running tool from the tubing hanger in the event of hydraulic system failure.

7 Claims, 18 Drawing Sheets

TOOL FOR RUNNING STRUCTURES IN A WELL

This is a division of co-pending application Ser. No. 003,117, filed on Jan. 14, 1987, now U S. Pat. No. 4,736,799.

BACKGROUND OF THE INVENTION

1. Field of the Invention

The present invention is directed to a tubing hanger assembly. More particularly, the present invention is directed to a tubing hanger seal assembly which provides a peripheral seal between the tubing hanger and the housing of a subsea wellhead. The tubing hanger seal assembly of the present invention has a Z-pack seal which is set upon running the tubing hanger assembly into the subsea wellhead. The tubing hanger seal assembly can be separately removed from the tubing hanger.

The tubing hanger assembly of the present invention is especially suited to be utilized in conjunction with subsea wellhead systems which have multiple casing strings and sealing casing hangers as disclosed more particularly, for example, in U.S. Pat. No. 4,488,740, which is incorporated in its entirety herein by reference. U.S. Pat. No. 4,488,740 discloses a subsea wellhead system which has multiple concentric casings. For example, the casings can range from sixteen inches down to seven inches. The tubing hanger assembly of the present invention is adapted to be seated above the uppermost casing hanger in the subsea wellhead system.

Another aspect of the present invention is that a running tool is specially designed to run the tubing hanger assembly of the present invention into position in the subsea wellhead an set the seals of the seal assembly in a single trip. The running tool is adapted for testing the seating of the tubing hanger and the tubing hanger seal assembly associated therewith in the subsea wellhead and for testing the seals between the tubing hanger and the subsea wellhead housing and between the tubing hanger and the casing hanger on which it seats to make certain that the seals can withstand the expected operating pressures.

2. Prior Art

U.S. Pat. No. 4,561,499 discloses a tubing suspension system for undersea well production operations which employs a non-oriented tubing hanger having an inner body for supporting a tubing string and a landing collar for supporting the tubing hanger on a wellhead casing. The tubing hanger includes three cooperating concentric sleeve assemblies which are employed to lock and seal the tubing hanger to the wellhead housing. The outer sleeve assembly includes a locking actuator and a dual seal assembly and is separately retrievable from the remainder of the hanger assembly. A non-orienting hydraulic set running tool is employed to run the tubing hanger, set the seals, lock the tubing hanger to the wellhead casing, and retrieve either the outer sleeve assembly or the entire tubing hanger. The running tool includes a hydraulically controlled actuating sleeve which carries a latch dog assembly which locks with the tubing hanger.

U.S. Pat. No. 4,381,868 discloses a pressure-actuated wellhead sealing assembly. The seal assembly is for sealing across an annular recess between the interior of a wellhead member and the exterior of a tubular member. The seal assembly includes a heat-resistant seal ring in the annular recess, a pressure-responsive ring for moving the seal ring into sealing position in the recess, latching means to retain the pressure-responsive ring in set position and spring means between the seal ring and the pressure-responsive ring to maintain a sealing force on the seal ring.

U.S. Pat. No. 3,809,158 discloses a well completion apparatus and method. The well completion apparatus includes a casing hanger which is suspended from a first member of a well tool and a sealing member which is suspended from a second member of the well tool. The first and second members are releasably connected whereby, upon landing the casing hanger within the well, the first member is disconnected from the second member and the sealing member is lowered into sealing position independently of the casing hanger. A portion of the sealing member is rotated to cause an expansion ring to engage an annular groove in the casing head thereby actuating the sealing member and locking the sealing member and casing hanger in position.

SUMMARY OF THE INVENTION

The present invention is directed to a tubing hanger assembly for a subsea wellhead system. The tubing hanger assembly includes a tubing hanger for supporting a plurality of tubing. A seal surrounds the lower end of the tubing hanger and provides a seal between the tubing hanger and the member, usually a casing hanger, on which the tubing hanger seats. A tubing hanger seal assembly provides a second seal for sealing the space between the tubing hanger and the housing of the subsea wellhead system. The tubing hanger seal assembly is also referred to herein as a packoff assembly, and includes a packoff sleeve having a seal at the lower portion thereof. The packoff sleeve has a circumferential internal shoulder for receiving a split lock ring disposed around the body of the tubing hanger, thereby locking down the packoff assembly. A plurality of dogs disposed in windows around the packoff sleeve comprise part of the release mechanism for the seal assembly. Radially outward of and surrounding the upper portion of the packoff sleeve is a releasing sleeve which, when pulled upwardly, axially actuates the release means, including the dogs, and unlatches the tubing hanger seal assembly for removal from the well separately from the tubing hanger, if desired.

The tubing hanger assembly is initially attached to a running tool whereby the running tool and tubing hanger assembly are positioned in a subsea wellhead assembly in a single trip operation. The running tool carries the tubing hanger assembly for seating within the wellhead housing and, preferably, on top of the uppermost casing hanger in the well. The running tool also actuates the tubing hanger seal assembly for sealing the space between the tubing hanger and the subsea wellhead housing. The seals between the tubing hanger and wellhead housing, and between the tubing hanger and the casing hanger on which it seats, may be tested utilizing the hydraulic system within the running tool to make certain that the tubing hanger assembly is positioned properly and the seals have been fully set. The running tool can also be utilized either to individually remove the tubing hanger seal assembly from the well, or to deactivate the seal of the tubing hanger seal assembly so that the entire tubing hanger assembly may be removed from the well.

BRIEF DESCRIPTION OF THE DRAWINGS

For a detailed description of the preferred embodiment of the present invention, reference will now be made to the accompanying drawings, wherein:

FIG. 1A shows the tubing hanger seal assembly in the unset and running-in position, while FIG. 1B shows the tubing hanger seal assembly in the set and partially disengaged position.

FIG. 2A shows that structure with the tubing hanger seal assembly in the unset and running-in position, while FIG. 2B shows that structure with the tubing hanger seal assembly in the set and partially disengaged position.

Before describing the tubing hanger assembly of the present invention in detail, note the following with respect to the drawings used to illustrate the present invention. A split longitudinal sectional view (which is a partial cross-section) is used to illustrate two different positions of the tubing hanger assembly and the running tool of the present invention. These two positions are (1) the running-in and unset position of the tubing hanger and running tool, and (2) the set position of the tubing hanger and running tool and the partially disengaged position of the packoff assembly with respect to the running tool. All of the structure and functional aspects of the tubing hanger assembly and running tool of the present invention are illustrated against these two positions, as well as all the necessary operations which enable the full and complete disclosure and description of the use of the tubing hanger assembly and running tool of the present invention.

Figure 14:
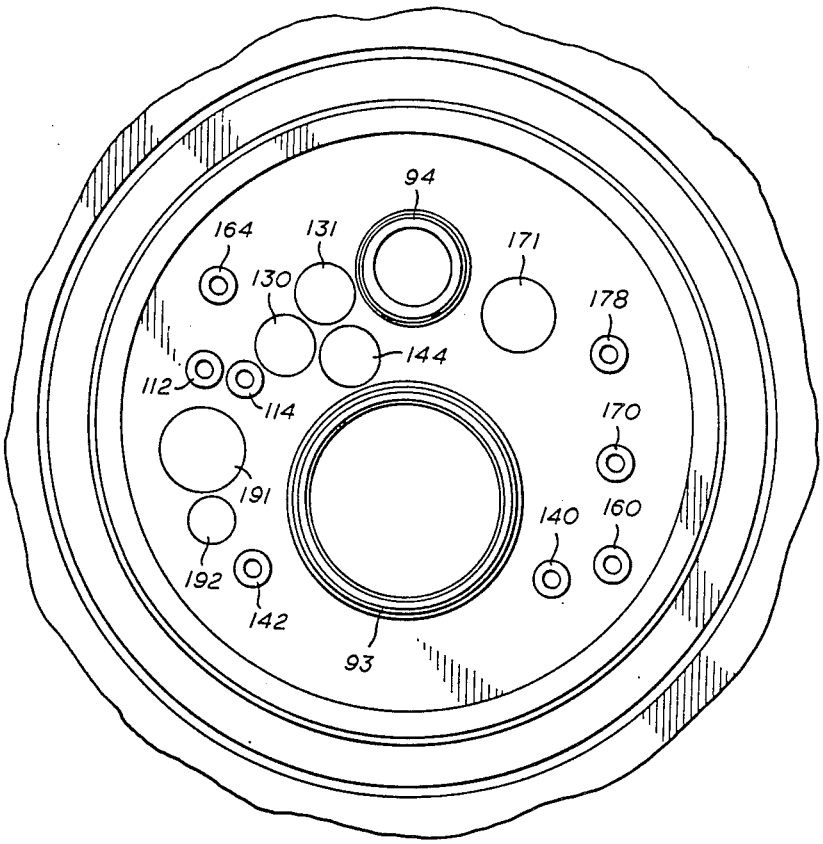
FIG. 14 is an index sectional view taken through the shuttle valve and also showing the relationship of the lines shown by FIGS. 4, 6, 8, 10 and 12.

The use of an index sectional view facilitates the disclosure of the hydraulic system and the plurality of lines disposed in the preferred embodiment of the running tool. The index sectional view is not a complete radial cross-section, but instead highlights only specific structure. The corresponding longitudinal sectional view of that specific structure illustrates its running-in and unset position, as compared to its set and unlatched position. It is noted that the drawings are not to scale, nor are there shown all the hydraulic lines or other lines which may be employed in a tubing hanger assembly of the present invention. In addition, it is noted that the particular positioning of the respective hydraulic lines and other structure is a matter of choice which is within the level of expertise of those of ordinary skill in the art. It is also noted that FIG. 14 shows an index to all of the various lines and provides an orientation guide to that particular structure in the preferred embodiment of the present invention.

DETAILED DESCRIPTION OF THE PREFERRED EMBODIMENT

The present invention is directed to a subsea tubing hanger assembly for a subsea wellhead system. Reference is made to FIG. and FIGS. 5A, 5B and 5C of U.S. Pat. No. 4,488,740 for a disclosure of the general environment of the tubing hanger assembly of the present invention. As is disclosed in FIG. 1 of U.S. Pat. No. 4,488,740, a well bore is drilled into the sea floor below a body of water from, for example, a drilling vessel floating at the surface of the water. A base structure or guide base, a conductor casing, a wellhead, a blowout preventer stack with pressure-control equipment, and a marine riser are lowered from the floating drilling vessel and installed on or into the sea floor. The conductor casing may be driven or jetted into the sea floor until the wellhead rests near the sea floor or, alternately, a bore hole may be drilled for the insertion of the conductor casing. A guide base is secured about the upper end of the conductor casing on the sea floor, and the conductor casing is anchored within the bore hole by a column of cement. A blowout preventer stack is releasably connected through a suitable connection to the wellhead disposed on the guide base mounted on the sea floor and includes one or more blowout preventers. The blowout preventer stack includes "choke and kill" lines which extend to the surface. The choke and kill lines are used for, among other things, testing the pipe rams of the blowout preventer. In testing the rams, a test plug is run into the well through the riser to seal off the well at the wellhead. The rams are activated and closed, and pressure is then applied through the kill line with a valve on the choke line closed to test the rams. As stated previously, this is a typical environment in which the subsea tubing hanger assembly of the present invention is employed.

Figure 1A:
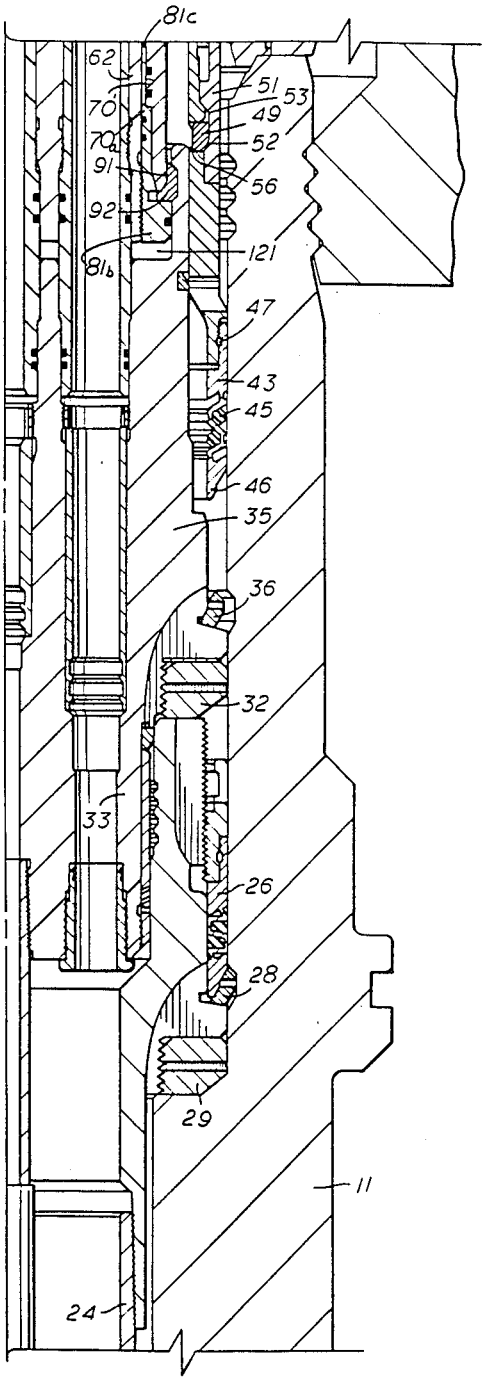
FIGS. 1A and 1B each is a split longitudinal sectional view of the tubing hanger assembly of the present invention and shows the lower portion of the running tool.
Figure 1B:
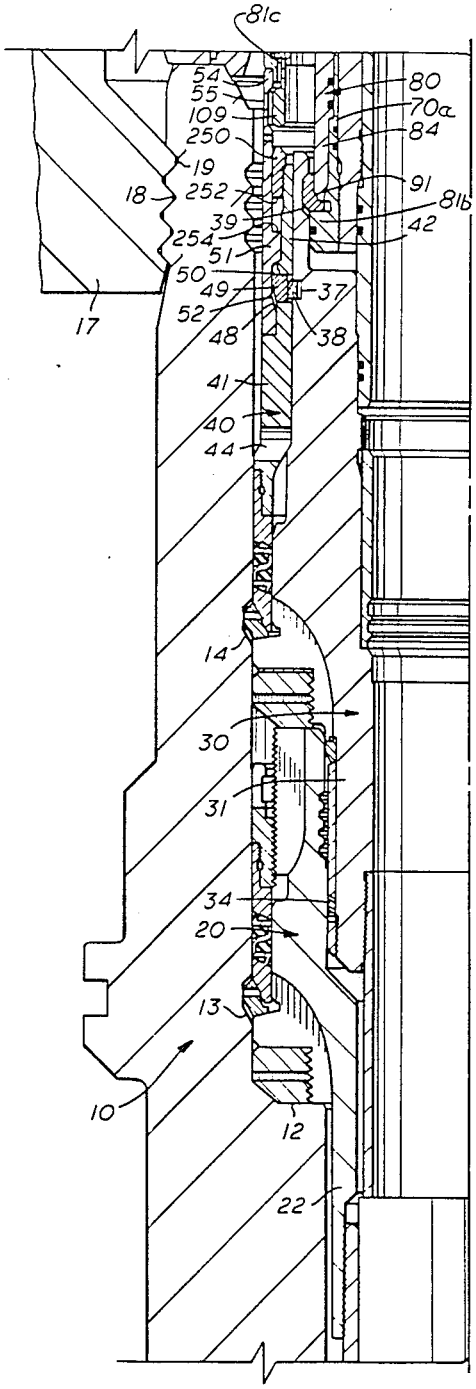
Figure 2A:
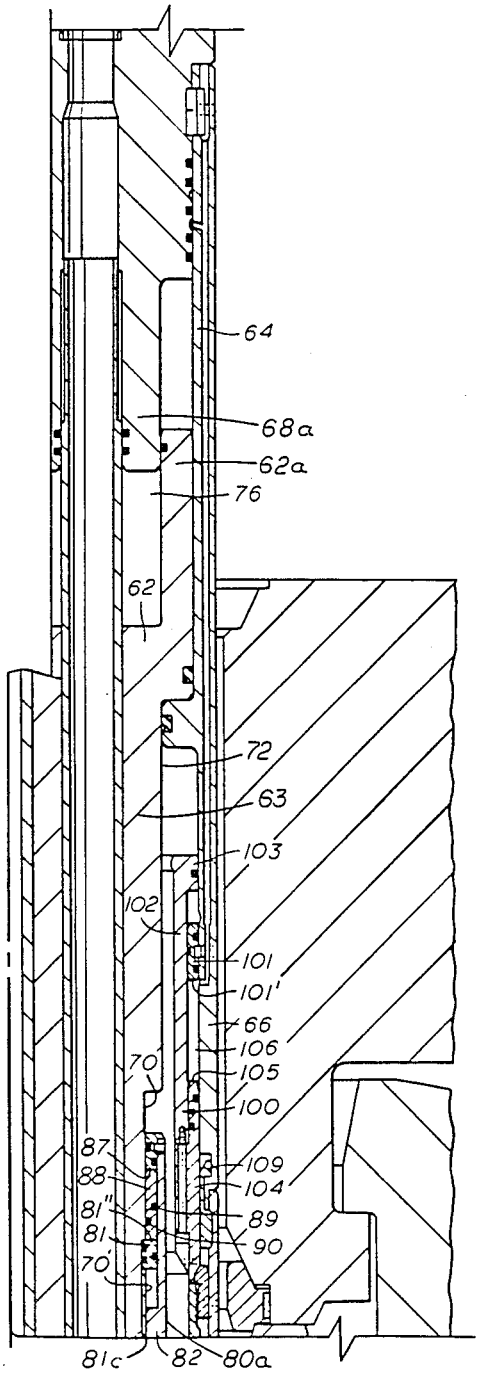
FIGS. 2A and 2B each is a split longitudinal sectional view of the running tool of the preferred embodiment of the apparatus of the present invention, and is the structure immediately above that in FIGS. 1A and 1B.
Figure 2B:
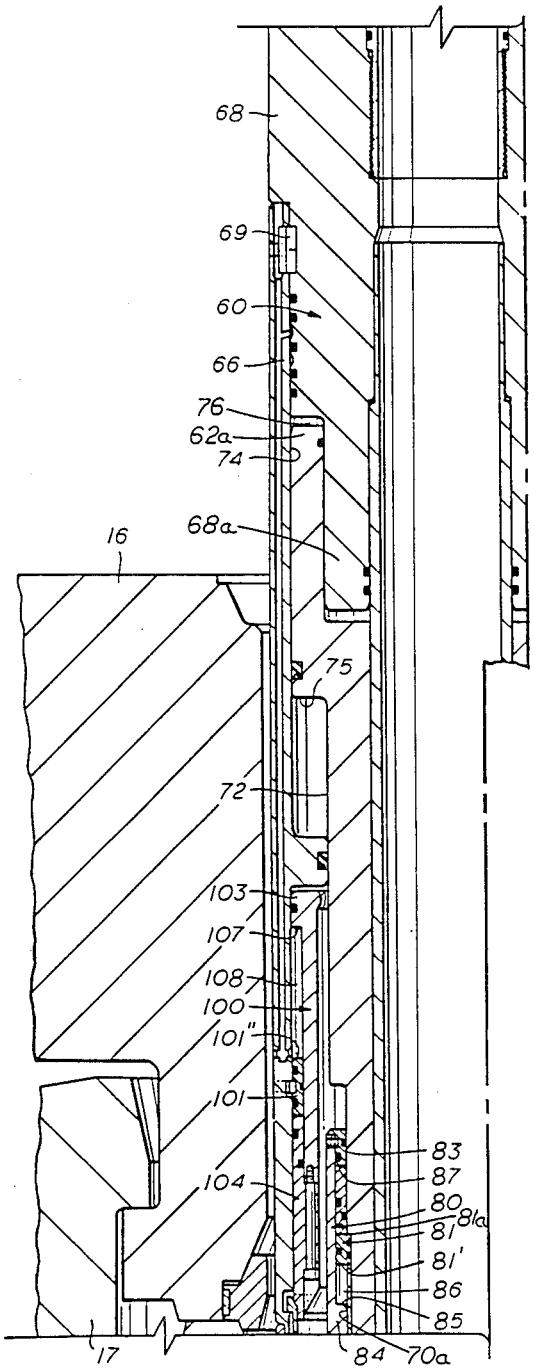

Now referring to the drawings directed to the present invention and, more particularly, to FIGS. 1A and 1B hereof, a subsea wellhead includes a housing 10. The housing 10 may have any of a plurality of known exterior configurations. The housing 10 extends from an upper portion 11 down into the well to a lower portion (not shown). The housing 10 has in the upper internal portion 11 thereof an upwardly facing shoulder 12. On the inner diametral surface of upper portion 11 of housing 10 are disposed circumferential grooves 13 and 14, the purpose of which will be described hereinafter. To the upper extremity of the upper portion 11 of the housing 10, there is attached a wellhead connector 16, the details of which are shown in FIGS. 2A and 2B. The wellhead connector 16 is locked to the housing 10 by a collet finger 17. The collet finger 17 has locking teeth 18, which lockingly engage notches 19 in the upper outer surface of the upper portion 11 of housing 10.

As illustrated in FIGS. 1A and 1B, the housing 10 contains therein an uppermost casing assembly 20 which includes a casing hanger 22 for suspending a casing 24. As a specific example, the casing hanger 22 may suspend a 10¾ inch O.D. casing which has an approximate weight of 32.75–55.5 lbs. per foot. The casing assembly 20 includes a seal assembly 26 which, as illustrated, has been set. In setting the seal assembly 26, the lowermost end of the seal assembly moves latch 28 into groove 13 for locking engagement of the casing assembly 20 to the upper portion 11 of housing 10. The casing assembly 20 has a load ring 29 which is attached to the casing hanger 22, and which when seated, rests on shoulder 12 of housing 10. The load of the casing assembly 20 and the casing 24 suspended therefrom is thus transferred through the load ring 29 and shoulder 12 to the housing 10.

Figure 5A:
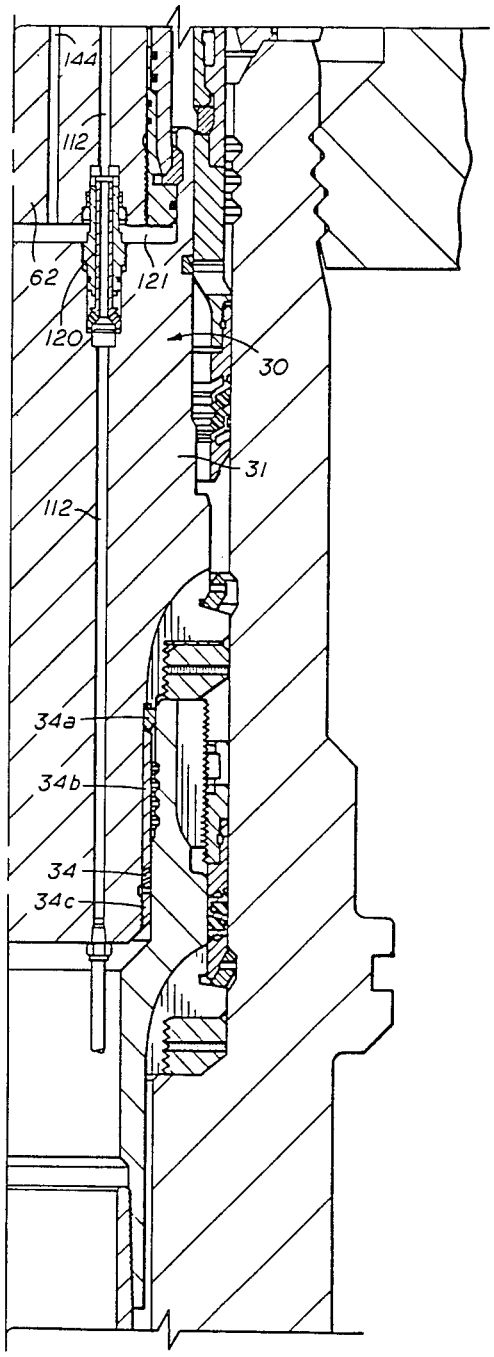
FIGS. 5A and 5B each is a split longitudinal sectional view of the tubing hanger assembly of the present invention with the detail taken through one control line and the test port shown in FIG. 4.
Figure 5B:
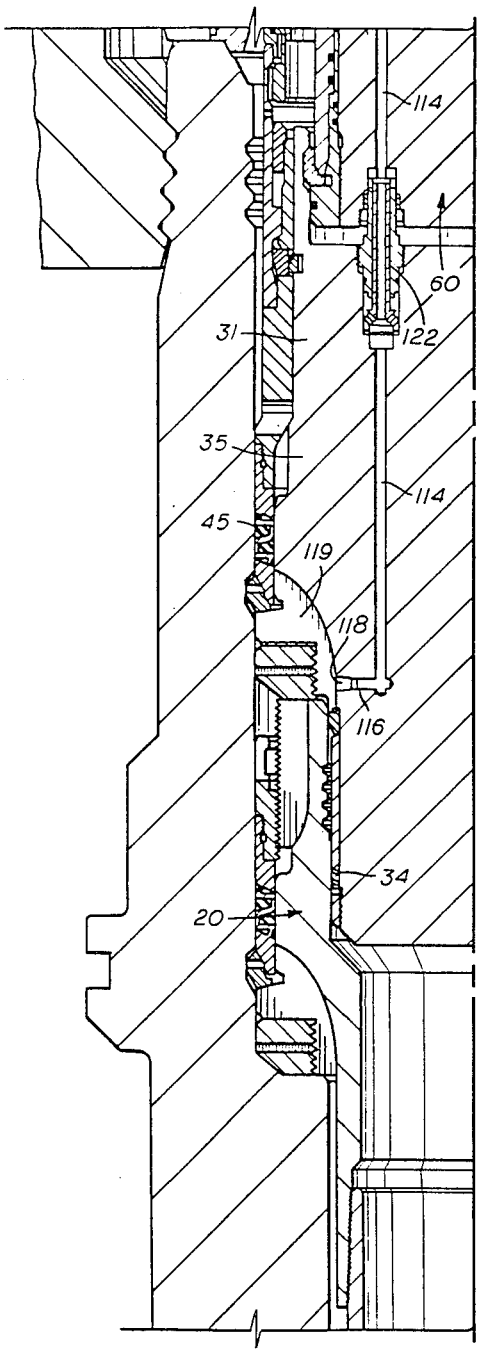

The structure illustrated in FIGS. 1A and 1B regarding the casing assembly 20 is preferably like that shown in FIG. 5A of U.S. Pat. No. 4,488,740. Furthermore, the structure of casing assemblies below casing assembly 20 which is not illustrated in the drawings hereof may also be like that structure which is illustrated in FIGS. 5B and 5C of that U.S. patent.

Tubing hanger assembly 30 of the present invention includes a tubing hanger 31 adapted, for example, to hang two tubing strings. As a specific example, tubing hanger 31 is adapted for a 5 inch tubing string and a 2 inch tubing string. The tubing hanger 31 has an outwardly extending shoulder which engages a shim adjustable load ring 32, which has been adjusted before inserting the tubing hanger 31 into the subsea wellhead. This shim adjustable load ring 32 rests on the uppermost extremity of the casing assembly 20 which provides a seat for the tubing hanger assembly 30 of the present invention. Furthermore, a substantial portion of the load of the tubing hanger assembly 30 is thus transferred through the load ring 32 onto the upper part of casing hanger body 22, into load ring 29, onto load shoulder 12 and then into the housing 10. The tubing hanger 31 has a lower end 33 of a size which fits within the uppermost casing assembly 20. Only one string of tubing is shown extending from the lower end 33 of the tubing hanger 31. Surrounding the lower end 33 of the tubing hanger 31 is a seal 34 for sealing the annulus between the tubing hanger 31 and the casing assembly 20. An example of a suitable seal for seat 34 is disclosed in U.S. Pat. No. 4,109,942. At approximately the middle of tubing hanger 31 is an outwardly extending body portion 35. Below outwardly extending body portion 35 and above the extending shoulder which engages the shim adjustable load ring 32, is a split lock ring 36 which is adapted to lock within the groove 14 of housing 10. In the upper portion of tubing hanger 31 around the outer periphery thereof is a circumferential groove 37 which houses an expansion ring 38 therewithin. Just below the upper end of tubing hanger 31, around the inner diametral surface, is a circumferential groove 39.

The tubing hanger assembly 30 further includes, but as a distinct and separate structure which can be separately removed, a tubing hanger seal assembly or a packoff assembly 40. The packoff assembly 40 includes a sleeve 41. The packoff sleeve 41 has an upper portion 42 (FIG. 1B) and a lower portion 43 (FIG. 1A). The inner surface of the upper portion 42 engages and slides on the outer surface of tubing hanger 31. In the, lower portion 43 of sleeve 41 are a plurality of openings 44 which permit fluid which surrounds the tubing hanger assembly 30 to flow therethrough when inserting the tubing hanger assembly 30 into the wellhead and into its seated position. On the lower portion 43 of packoff sleeve 41 is a seal 45. The seal 45 is preferably a Z-pack seal similar to that which is disclosed in U.S. Pat. No. 4,488,740. A nose portion 46 at the lower extremity of the lower portion 43 of packoff sleeve 41 engages the split lock ring 36 when seal assembly 40 is seated, and forces ring 36 to expand into groove 14 to lock the tubing hanger assembly 30 to the housing 10. The upper portion 42 and the lower portion 43 of the packoff sleeve 41 are connected by connection means 47. The connection means 47 is preferably a plurality of ball bearings disposed in a race which permits the two portions to be rotatable one to the other; however, other connection means, such as a threaded connection, may be used.

The packoff sleeve 41, in the upper portion 42 thereof, includes a release means 48. The release means 48 includes a plurality of dogs 49 each disposed in one of a plurality of circumferentially disposed radial holes 50. Surrounding the upper portion 42 of the packoff sleeve 41 and extending below the ring of dogs 49, is a release sleeve 51. The release sleeve 51, on its lower portion and below the ring of dogs 49, has a ramp surface 52 which extends into a circumferential groove 53. The upper portion 54 of the release sleeve 51 has a circumferential groove 55 on the interior surface thereof for connection to the running tool 60 as will be described in more detail hereinafter. There is an internal circumferential shoulder 56 on the upper portion 42 of the packoff sleeve 41. This internal shoulder 56 will receive expansion ring 38 to provide lockdown means for releasably locking packoff assembly 40 to tubing hanger assembly 30.

The running-in operation for placing the tubing hanger assembly 30 and, more particularly, the packoff assembly 40 thereof, into the subsea wellhead is illustrated by comparing FIGS. 1A and 2A with FIGS. 1B and 2B. The running tool 60, which is described in more detail hereinafter, is locked to the tubing hanger 31 and the release sleeve 51 of the packoff assembly 40 in the running-in position as is shown in FIG. 2A. As illustrated in FIG. 1A, when the tubing hanger assembly 30, which includes the packoff assembly 40, is lowered in a single operation or trip, the shim adjustable load ring 32 carried by tubing hanger 31 seats on the upper extremity of casing hanger 20. As the assembly 30 is lowered, the lower portion 33 of tubing hanger 31, which carries seal 34, energizes that seal 34 against the inner surface of casing hanger 20. After the tubing hanger assembly 30 is seated and seal 34 is in sealing engagement with the casing hanger 20, the tubing hanger seal assembly or packoff assembly 40 is then ready to be set. In the running-in position, the packoff sleeve 41 is positioned such that it maintains the expansion ring 38 recessed in groove 37 of the tubing hanger 31 (compare FIG. 1A with FIG. 1B). The packoff sleeve 41 is set by the running tool 60, which provides further axially downward movement to the packoff assembly 40 (moving from the position shown in FIG. 1A to FIG. 1B). As the packoff assembly 40 is moved downward, the internal shoulder 56 lines up with the groove 37 so that the expansion ring 38 expands into the internal shoulder 56, locking the packoff assembly 40 in place. Before this lock down occurs, however, the nose 46 of the packoff sleeve 41 engages split lock ring 36, forcing the split lock ring 36 into the groove 14 of housing 10. Further downward movement of the packoff assembly 40 sets the seal 45, sealing the annulus between the outwardly extending body portion 35 of the tubing hanger 31 and the housing 10. Referring to FIG. 1B, the split lock ring 36 is secured in groove 14 of the housing 10, the seal 45 is set and the expansion ring 38 is in the "out" or locked position. The running tool 60 in FIG. 1B is shown detached from the packoff sleeve 41; however, FIG. 1B also illustrates the tubing hanger assembly 30 set and ready for operation.

Prior to the running tool 60 being released from the tubing hanger assembly 30, the seals 34 and 45 are tested to make certain that the seals will withstand the expected pressure which may be encountered in operation. Both seals can be tested both from above and from below to make certain that the tubing hanger assembly 30 is properly seated and sealed, while making only a single run of the running tool 60 into the wellhead. The testing operations are described hereinafter; prior to that, however, the running tool 60 is described in detail Referring now to FIGS. 2A and 2B, as well as FIGS. 1A and 1B, a running tool, generally indicated as 60, of the preferred embodiment of the present invention is illustrated. It is again noted that the right hand portion or FIG. 2A shows the position of the running tool 60 in the above water assembled and running-in position, and the left hand portion or FIG. 2B shows the running tool 60 in a position where the running tool 60 has energized seal 45 and has been released from packoff assembly 40. FIGS. 2A and 2B are upward extensions of FIGS. 1A and 1B. Some of the details of the running tool 60 as they deal with the attachment to the tubing hanger assembly 30 are shown in FIGS. 1A and 1B rather than in FIGS. 2A and 2B.

Running tool 60 includes lower generally tubular cylindrical body 62, upper, movable surrounding member 64 which includes sleeve 66 disposed around body 62 and upper tool body 68. Tool body 68 contains the various hydraulic connections which are described hereinafter. Tool body 68 and sleeve 66 are interconnected by connection means 69. The lower portion **68*a* of body 68 is reduced in outer diameter to be received within the interior of body 62 which has an upper end portion 62*a* of increased inner diameter. The interior of body 62 defines an annular cavity 76 into which lower portion 68*a* of tool body 68 may slip and the exterior portion of lower reduced portion 68*a* of tool body 68 become sealingly engaged with the interior sidewall of upper end portion 62*a* of lower generally tubular cylindrical body 62**.

Surrounding the lower portion of body 62 of running tool 60, and more specifically, surrounding and in partial engagement with the surface 70, is a movable tubing hanger latching assembly 80 for releasably attaching the tubing hanger assembly 30 to the running tool 60. The tubing hanger latching assembly 80 includes a fixed ring 81 which is sealingly disposed around the intermediate surface 70 of body 62. Ring 81 is supported against shoulder **81*a* by tubular member 81*b* which is threaded onto the lower end of body 62 and which has an upwardly extending portion 81*c* with an outer diameter 70' which is substantially equal to the diameter of surface 70. A tubing hanger latch body 80*a* comprising movable sleeve 82 sealingly engages the outer surface of ring 81. The movable sleeve 82 has an upper portion or piston end 83 which is in sealing engagement with surface 70. The movable sleeve 82 has a lower portion or piston end 84 which is in sealing engagement with surface 70' and is located below fixed ring 81. The upper surface 85 of lower portion 84 is a piston surface for moving the movable sleeve 82 downwardly. The piston surface 85 and the lower surface 81' of fixed ring 81 forms a piston chamber 86. Similarly, the lower surface 87 of upper portion 83 comprises a piston surface, and the upper surface 81'' of fixed ring 81 comprises another piston surface. Between these two piston surfaces 87, 81'' is disposed an annular piston 88, the purpose and function of which will be apparent from the description hereinafter. Annular piston 88 has an upper seal 89 which sealingly engages the movable sleeve 82 and a lower seal 90 which sealingly engages surface 70. The space surrounding the annular piston 88 above seals 89 and 90 and bounded from above by surface 87 comprises an upper piston chamber, and the space surrounding the annular piston 88 below seals 89 and 90 and bounded from below by surface 81''** comprises a lower piston chamber.

At the lower end of the movable sleeve 82 is a ram surface end 91 which engages a locking ring 92 which locks the tubing hanger assembly 30 to the running tool 60 by forcing locking ring 92 into groove 39 in the upper portion of tubing hanger 31.

At the lower end of surrounding sleeve 66 and internally thereof is a seal or packoff latching assembly 100. The seal or packoff latching assembly 100 includes a fixed ring 101 which is sealingly fixed to surrounding sleeve 66. A packoff latch body comprising a movable sleeve 102 engages the inner surface of fixed ring 101. Fixed ring 101 is also in sealing contact with sleeve 102. The movable sleeve 102 has an upper portion or piston end 103 which is in sliding and sealing engagement with the inner surface of surrounding sleeve 66. The movable sleeve 102 has a lower body portion or piston end 104 which also is in sliding and sealing engagement with the inner surface of surrounding sleeve 66. The upper surface 105 of the lower body portion 104 comprises a piston surface. The lower surface 101' of fixed ring 101 and the piston surface 105 bound a piston chamber 106. Similarly, the lower surface 107 of upper portion 1O3 comprises a piston surface. The upper surface 101" of fixed ring 101 and piston surface 107 bound a piston chamber 108. At the lower end of surrounding sleeve 66 is a lock ring 109 which locks the tubing hanger seal assembly 40 to the running tool when the lower body 104 is moved downward and bears against the inner surface of the locking ring 109 so as to seat it in groove 55 of tubing hanger seal assembly 40.

The running tool 60 has a hydraulic system which, generally, comprises all of the hydraulic lines, chambers, valves, and ancillary equipment necessary for moving the pistons and operating the latching assemblies discussed previously.

Figure 3:
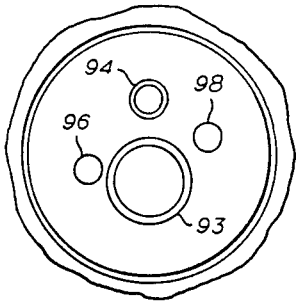
FIG. 3 is an index sectional view of the apparatus shown in FIGS. 2A and 2B. An index sectional view shall mean a partial cross-sectional view where certain structure is simplified or highlighted for facilitating disclosure of certain operations without a complete sectional view being made. Such a view is used primarily to show some of the numerous fluid lines, testing lines and tubing in the apparatus of the present invention. This FIG. 3 index sectional view is at the interface between the tubing hanger and the running tool.

Referring now to FIGS. 3 through 15A and 15B, the hydraulic system is described in detail. Reference to the various index views, i.e., FIGS. 3, 4, 6, 8, 10, 12, and 14, illustrates the positioning of the various hydraulic lines in relation to each other and the two stab subs. The corresponding longitudinal cross-sectional views highlight certain specific hydraulic lines or testing lines; they are partial cross-sectional views which, along with the index views, facilitate an understanding of the operation of the running tool 60. The various index views, except for FIG. 3, are cross sections of the highlighted lines at the upper end of the running tool 60 and designate the location of the hydraulic connections at the end of the running tool 60. FIG. 3 is a cross-section at the interface between the tubing hanger assembly 30 and the running tool 60, showing primarily the two alignment pins 96, 98 which align the running tool 60 with the tubing hanger assembly 30 either when assembled at the surface or when retrieving the assembly 30 in the well. Also in FIG. 3 are shown the two stab subs 93, 94 , for example, a two-inch and a five-inch stab sub. It should be understood that for the respective longitudinal cross sections, all the appropriate and connecting hydraulic lines, whether in the running tool 60 or the tubing hanger assembly 30, are shown, but in some instances, certain of the hydraulic lines are rotated into the plane of the page in order to accomplish that.

Referring now to FIG. 3, two alignment pins 96 and 98, which are disposed at the lower end of running tool 60 and extend into the top end of the tubing hanger assembly 30, provide orientation means for orienting the bores for the stab subs (five inch sub 93 and two inch sub 94) between running tool 60 and hanger assembly 30.

Figure 4:
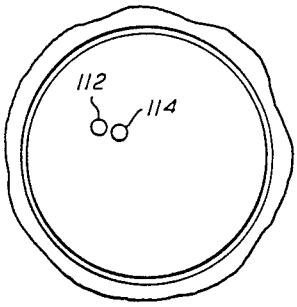
FIG. 4 is an index sectional view taken through one control line and the test port between the lower seal (between the tubing hanger and casing hanger) and the seal of the tubing hanger seal assembly (between the tubing hanger and wellhead housing).

Now referring to FIG. 4 and FIGS. 5A and 5B, control line 112 is shown in FIG. 4 and FIG. 5A. The test port line 114 is shown in FIG. 4 and FIG. 5B. The control line 112 extends through the body 62 of the running tool 60 as well as the tubing hanger 31 of the tubing hanger assembly 30. On the other hand, the test port line 114 extends through the body 62 of the running tool 60 and into the tubing hanger 31 but terminates at a point above the seal 34.

Seal 34 is preferably a Belleville-type seal which is assembled on the lower end of the body of tubing hanger 31 by first installing an expansion ring 34*a* around the bottom of tubing hanger 31 and sliding it upwardly until it seats. Below ring 34*a* is placed a sleeve 34*b*, and then the Belleville seal, a seal which is well known in the art. Ring 34*a*, sleeve 34*b*, and seal 34 are all held in position by a sleeve 34*c* threaded around the lower end of tubing hanger 31. Seal 34 is set against the inner surface of casing hanger 20 when tubing hanger 31 is lowered into and seats atop casing hanger 20. Ring 34*a* assists the setting of seal 34 upon engaging the inner surface of casing hanger 20 when it is forced inwardly and coacts with the upper surface of sleeve 34*b* to in turn press downwardly upon the seal 34.

A radial line 116 connects to test port line 114 and extends to an opening 118 above the seal 34 into an area 119 which is notched or fluted to accommodate the passage of fluid around the outer surface of the outwardly extending body portion 35 of tubing hanger 31. Between the line 112 in the running tool 60 and the tubing hanger assembly 30 is a connector 120. Similarly, connector 122 connects line 114 in the running tool 60 and the tubing hanger assembly 30. As described in more detail hereinafter, seals 34 and 45 can be tested from above and below by applying fluid under pressure to make certain that the seals will adequately withstand operating pressures before the running tool is detached and as a part of the single trip of the tubing hanger and tubing into the well.

Figure 6:
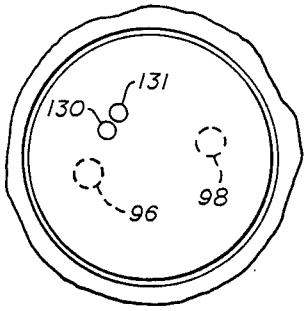
FIG. 6 is an index sectional view taken through the hydraulic indicator and alignment pins.
Figure 7A:
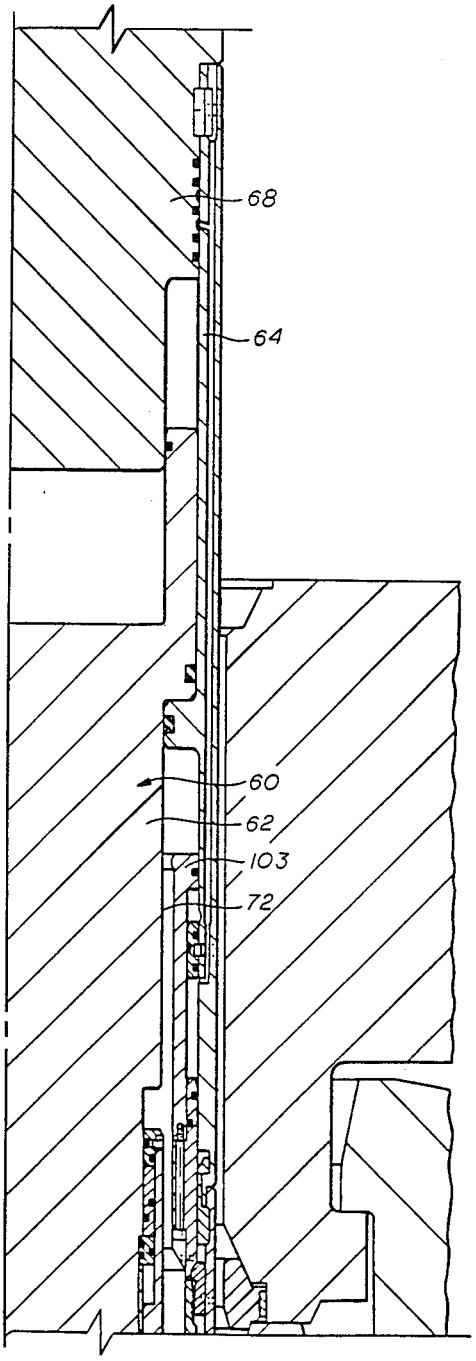
FIGS. 7A and 7B each is a split longitudinal sectional view of the running tool of the present invention with the detail taken through the hydraulic indicator and one of the alignment pins shown in FIG. 6.
Figure 7B:
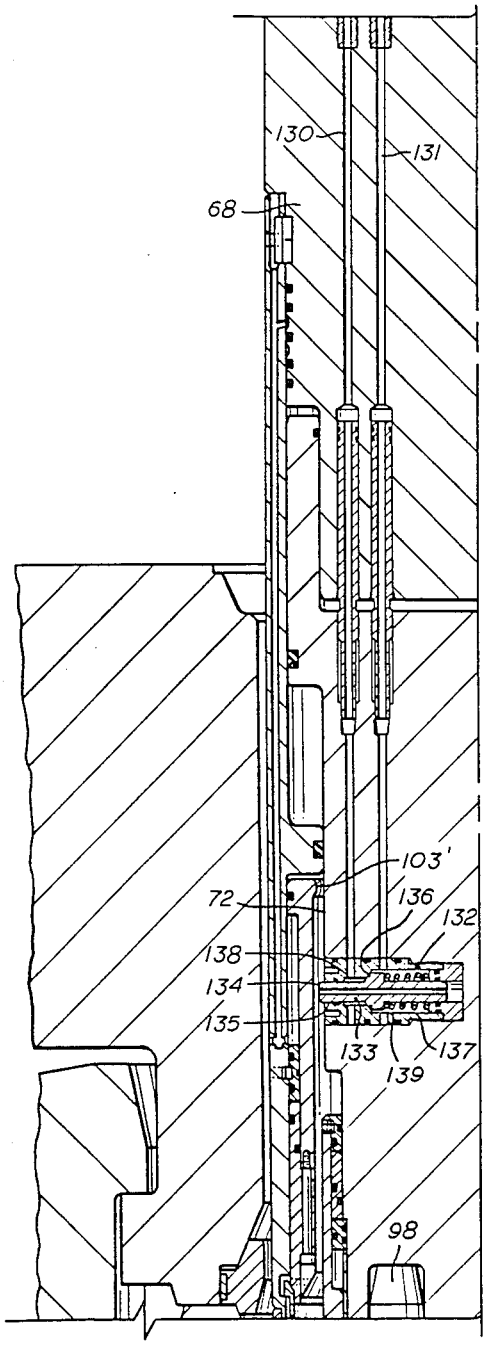

Referring to FIG. 6 and FIGS. 7A and 7B, lines 130 and 131 are highlighted in the cross section of FIG. 6. Lines 130 and line 131 extend from the top end of the running tool 60 through the upper portion 68 and into the body 62 where the lines terminate in a hydraulic indicator 132. The hydraulic indicator 132 is used to indicate that the seal latching assembly 100 reaches its lowermost position, moving concurrently with sleeve 66, which in turn has moved the packoff assembly 40 to its set position. When moved downwardly to its set position, the nose portion 46 of the packoff assembly 40 engages the split lock ring 36 and then the Z-pack seal 45 is set. However, the movement downward must also be sufficient that the expansion ring 38 carried by tubing hanger 31 expands onto shoulder 56 on the packoff sleeve 41, releasably locking the packoff assembly 40 to the tubing hanger 30. The hydraulic indicator 132 has a stem 133 with a probe 134 at the end thereof which extends through an opening 135 in surface 72. The stem 133 has a piston face 136 which is forced radially outwardly by spring 137 behind the piston face 136. Radially inward of the opening 135 is a chamber 138. Line 130 terminates in the chamber 138. Line 131 terminates in the closed position at the expanded body of stem 133 when the stem is in its radially outermost position; when stem 133 is move radially inwardly, line 131 also terminates in chamber 138. A longitudinal bore 139 extends through the center of stem 133 in order to pressure-balance the stem 133 of the hydraulic indicator 132, which permits spring 137 to maintain the stem 133 in an outwardly extended position. The seal latching assembly 100 has an internal cam surface 103" on the upper portion 103. When the seal latching assembly 100 is actuated downward by the hydraulic system 110, to indicate that the packoff assembly 40 is latched to the tubing hanger assembly 30 and the seal 45 is energized, the movement downward is such that the internal cam surface 103' contacts the probe 134 of the stem 133. This moves the stem 133 inward, which lifts the piston face 136 thereby opening chamber 138 for fluid flow through line 131 and back up through line 130. The return fluid from line 130 indicates movement of seal latching assembly 100 sufficiently that the packoff assembly 40 is installed and set. At this point, a bagtype blowout preventer (see below) can be closed around the running tool and pressure applied through the choke or kill lines into the annulus above seal 45 to pressure test it, leakage being monitored through line 114. A pressure test from below through line 114 verifies that seal 45 of packoff assembly 40 is good and split lock ring 38 has locked the packoff assembly to the tubing hanger 30.

Figure 8:
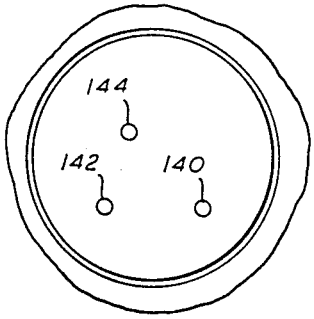
FIG. 8 is an index sectional view taken through the latching port and unlatching port for the tubing hanger and the stab sub test port.
Figure 9A:
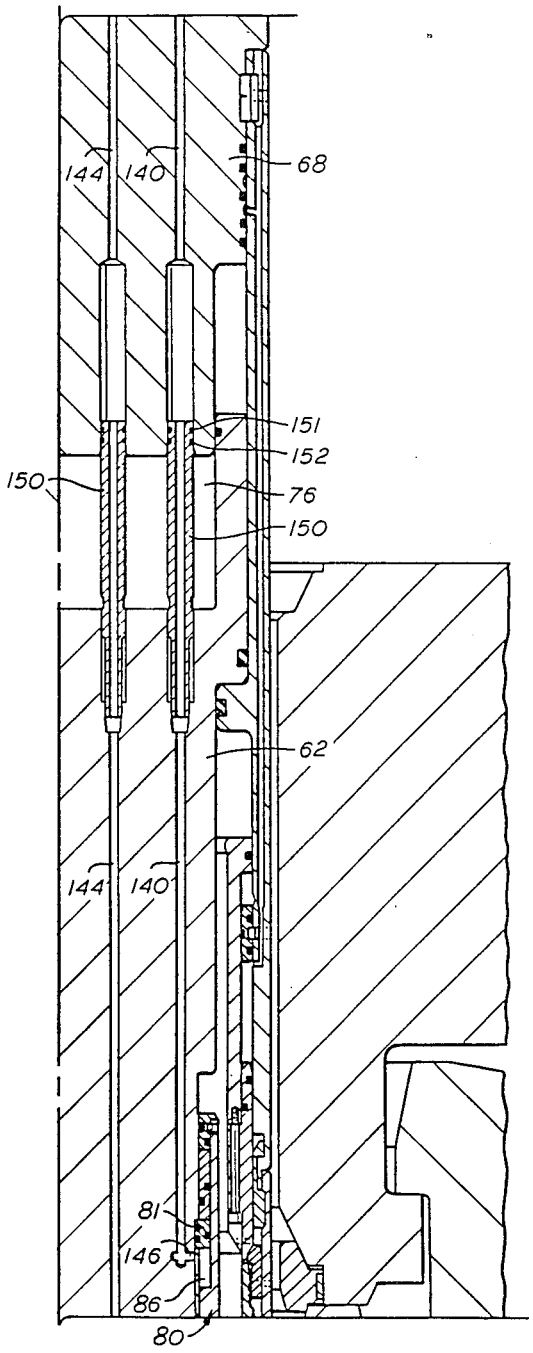
FIGS. 9A and 9B, each is a split longitudinal sectional view of the running tool of the present invention with the detail taken through the latching port and unlatching port for the tubing hanger and the stab sub test port shown in FIG. 8.
Figure 9B:
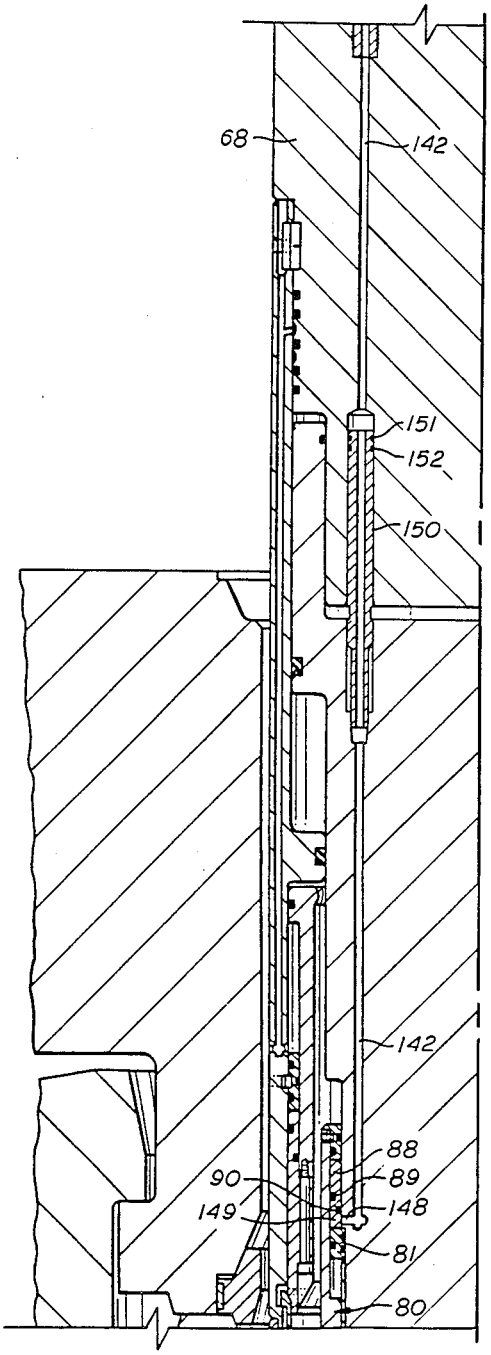

Now referring to FIG. 8 and FIGS. 9A and 9B, lines 140 and 142 are shown in the highlighted cross section of FIG. 8 together with a stab sub test port 144. Line 140 extends through upper portion 68 into the body 62 of the running tool 60 and terminates at a point below ring 81, with a radial line 146 extending between the terminus of line 140 and the piston chamber 86. With pressure applied to fluid in line 140 and filling chamber 86, the tubing hanger latching assembly 80 is forced downwardly and maintained in its downward latched position. The latching assembly 80, when forced downwardly, has a ram surface end 91 which forces locking ring 92 into groove 39 in the upper portion of tubing hanger 31. Line 142 extends through the upper portion 68 and into the body 62 of the running tool 60 and terminates above ring 81, with a radial line 148 extending between the terminus of line 142 and the lower piston chamber 149 in which annular piston 88 operates. The lower piston chamber 149, which was discussed above but not indicated by reference number, is below the seals 89 and 90 on the annular piston 88 and above ring 81. To unlatch the running tool from the tubing hanger, fluid pressure is applied through lines 142 and 148 into chamber 149, whereby the tubing hanger latching assembly 80 is raised and enables the locking ring 92 to be released from the groove 39 in the upper portion of tubing hanger 31.

The stab sub test port 144 extends through upper portion 68 into body 62 of the running tool 60 and terminates at the bottom of body 62 (see FIG. 5A). Stab sub test port 144 enters cavity 121, which is formed between the walls an bottom of a recess in the upper end of the tubing hanger body and the lower face of body 62 of the running tool 60. With the running tool 60 installed and connected to the tubing hanger assembly 30, it is possible to pressure test stab subs 93 and 94, connector 120, and connector 122 before running the tubing hanger assembly 30 into the well.

FIGS. 9A and FIG. 9B also illustrate the connecting means 150 for the lines (here, lines 140, 142, 144) between the upper portion 68 and the body 62 of running tool 60. The connectors 150 extend upwardly out of body 62, through the chamber 76, and into enlarged diameter portions of the lines in the upper portion 68 of the running tool 60. The upper ends of the connectors 150 carry seal rings 151, 152 which seal against the walls of the larger diameter portions of the lines in upper portion 68. As the upper portion 68 moves downwardly into the position shown in FIG. 9B, the upper ends of connectors 150 having the seal rings 151, 152 disposed thereon simply extend farther into the enlarged diameter portions of the lines. Thus, sliding sealed connections between connectors 150 and the enlarged diameter portions of the lines, resulting in continuous sealed lines from the upper portion 68 to the body 62 independent of the axial position of the upper portion 68 with respect to the body 62 of the running tool 60.

Figure 10:
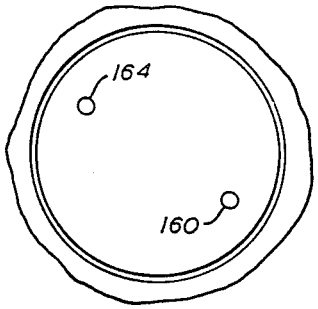
FIG. 10 is an index sectional view taken through the tubing hanger seal assembly latching port and unlatching port.
Figure 11A:
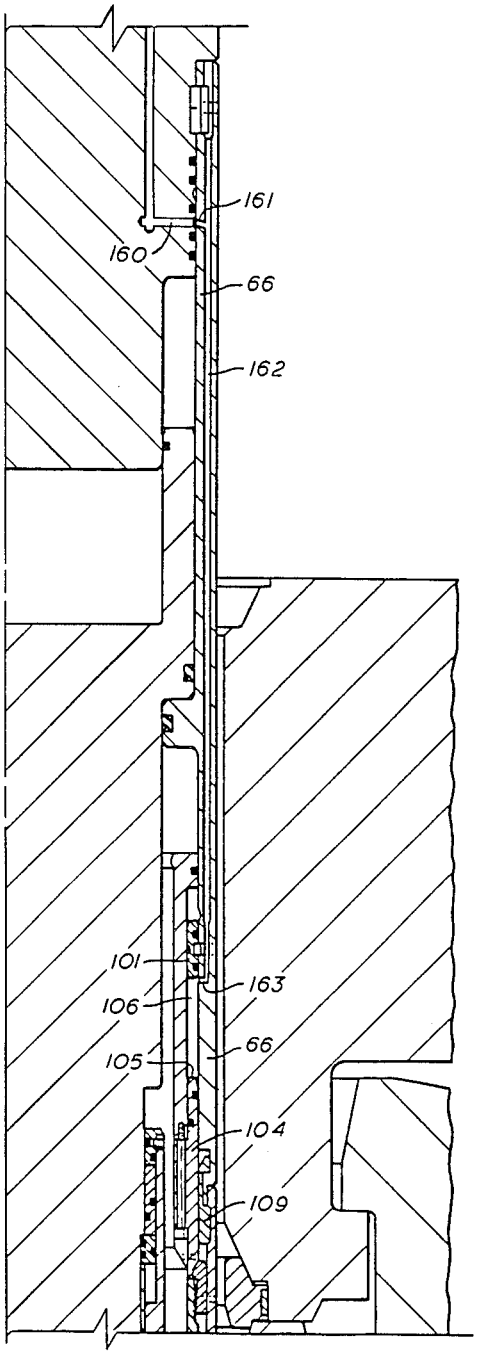
FIGS. 11A and 11B each is a split longitudinal sectional view of the running tool of the present invention with the detail shown in FIG. 10.
Figure 11B:
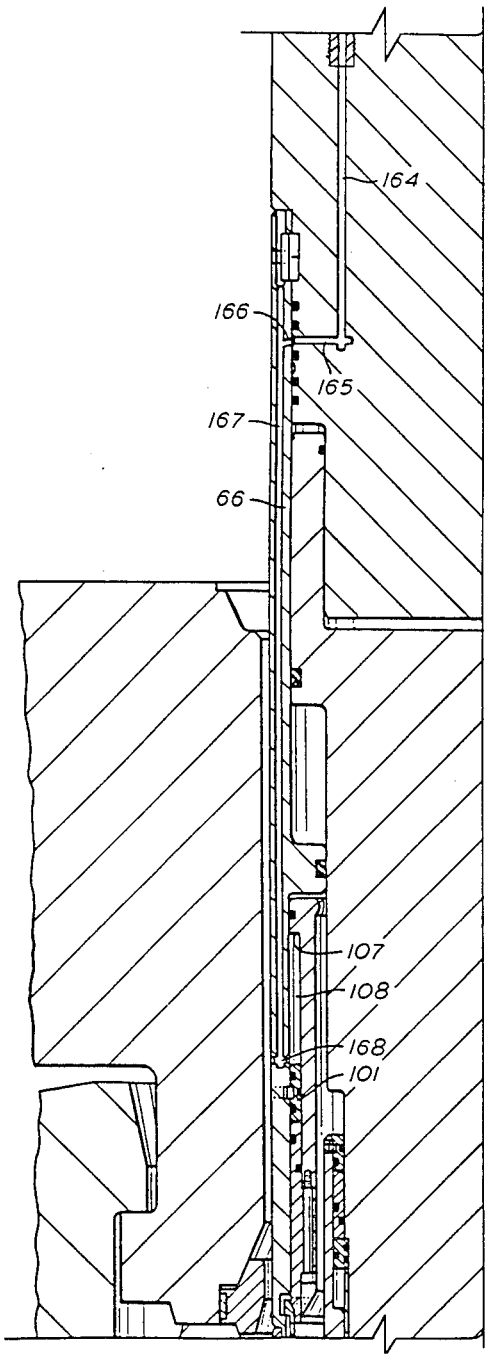

Referring now to FIG. 10 and FIGS. 11A and 11B, latching port 160 and unlatching port 164 are shown. With upper portion 68 of running tool 60 in its raised position with respect to lower body 62, latching port 160 is in communication with an opening 161 on the inner surface of surrounding sleeve 66. A longitudinal fluid line 162 in communication with opening 161 extends in sleeve 66 from above the opening 161 to a point below the fixed ring 101. Line 162 terminates in a radial line and opening 163 which is in fluid communication with the piston chamber 106. The fluid in chamber 106 when pressured through lines 160, 162 forces the piston surface 105 downwardly which, when running the tool into the well, maintains the tubing hanger seal assembly 40 in the latched position. The seal latching assembly 100 of the running tool, when maintained in its lowest longitudinal position in relation to the surrounding sleeve 66, maintains the lower body portion 104 in contact with the lock ring 109. This contact forces lock ring 109 into groove 55 of the tubing hanger seal assembly 40. To unlatch the tubing hanger seal assembly 40, with upper portion 68 of running tool 60 in its lowered position with respect to body 62, pressure fluid is passed down line 164, which terminates in a radial line 165 in communication with an opening 166 in the inner surface of sleeve 66. The opening 166 is in communication with a longitudinal passageway 167 in surrounding sleeve 66 which terminates at a point above the fixed ring 101. A radial line and opening 168 in communication with passageway 167 extends into piston chamber 108. When pressure fluid is passed through lines 164, 165, 167, 168 against piston surface 107, the seal latching assembly 100 is lifted in relation to the surrounding sleeve 66. In the lifted position (FIG. 1B), the lower body portion 104 is not in engagement with lock ring 109, permitting lock ring 109 to be cammed out of groove 55 when running tool 60 is lifted, and the latching assembly 100 is in the unlatched position with regard to tubing hanger seal assembly 40.

Figure 12:
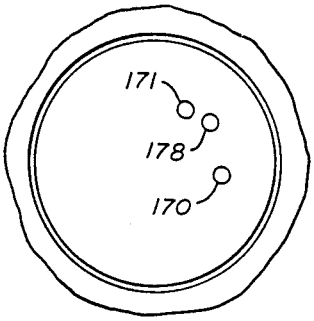
FIG. 12 is an index sectional view taken through the tubing hanger seal assembly setting port and unsetting port and a chamber port.
Figure 13A:
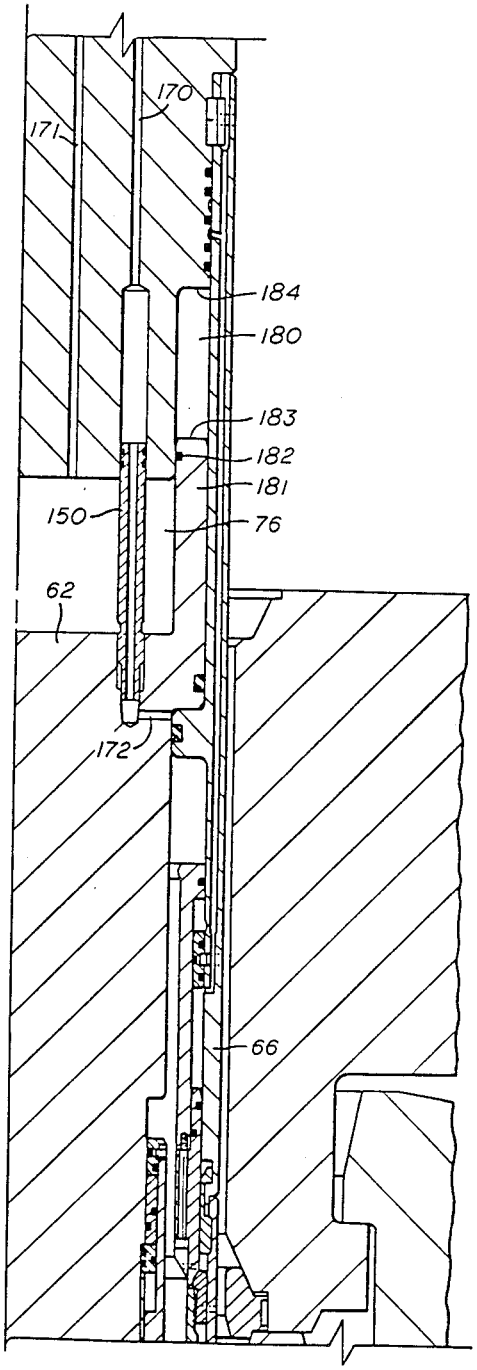
FIGS. 13A and 13B each is a split longitudinal sectional view of the running tool of the present invention with detail shown in FIG. 12.
Figure 13B:
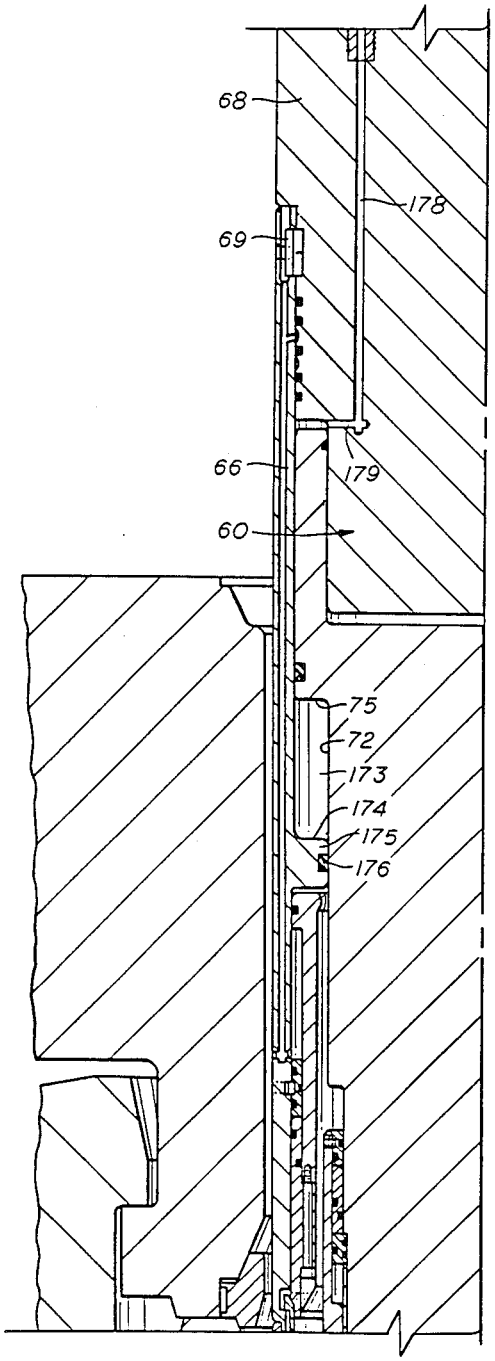

Referring now to FIG. 12 and FIGS. 13A and 13B, line 170, line 171 terminating in chamber 76, and line 178 are shown. Fluid from the hydraulic system is communicated through line 170 and through connector 150 into a radial line 172 in body 62 of running tool 60, and into a chamber 173. Chamber 173 (FIG. 13B) is formed by the surface 72 of body 62, the external annular piston surface 75 of body 62, the inner surface of surrounding sleeve 66, and the upper internal annular piston surface 174 of an annular body 175 of sleeve 66 which is sealingly engaged to surface 72 by seal 176. A similar seal carried in a circumferential groove in the outer surface of body 62 above piston surface 75 seals against the inner surface of sleeve 66. When pressurized actuation fluid is introduced into chamber 173 from lines 170, 150, 172, internal annular piston surface 174 of movable sleeve 66 is forced downward with respect to body 62, which also forces the surrounding sleeve 66 to move downward with respect to body 62. The line 170 is shown only in FIG. 13A, but the result of such downward movement is shown in FIG. 13B. During the seal setting operation, this downward movement of sleeve 66 forces the packoff assembly 40 to move downwardly with respect to tubing hanger 31. This downward movement of the seal assembly 40 also locks the tubing hanger assembly 30 to the housing 10 by forcing the expansion ring 36 into the mating groove 14 of the housing 10. Such downward movement of packoff assembly 40 also sets the seal 45 between the housing 10 and the extending body portion 35 of the tubing hanger 31; and it actuates the expansion ring 38 housed within the groove 37 to engage the mating groove of shoulder 56, on the upper portion 42 of the packoff sleeve 41. During the running into the well of the running tool 60 and tubing hanger assembly 30, fluid is maintained in chamber 76 through line 171 until the operator is ready to set the tubing hanger seal assembly 40. At that time, the fluid in chamber 76 is displaced through line 171 to allow upper body 68 to move downward relative to body 62 (see also FIG. 15A).

Pressure fluid from the hydraulic system is communicated through the line 178 into a connecting radial line 179 of upper portion 68 and into a chamber 180 to retract the upper body 68 upwardly relative to body 62. The upper portion of body 62 comprises a sleeve 181 in which the lower portion of upper body 68 is slidingly received. Annular seal 182 seals between such telescoping portions of the two bodies 68, 62. Chamber 180 is bounded by an annular upper surface 183 of sleeve 181 and by the piston face 184 of the upper portion 68 of the running tool 60. When hydraulic pressure is applied to chamber 180, the hydraulic pressure forces the upper portion 68 and surrounding sleeve 66 to move upwardly with respect to body 62.

Figure 15A:
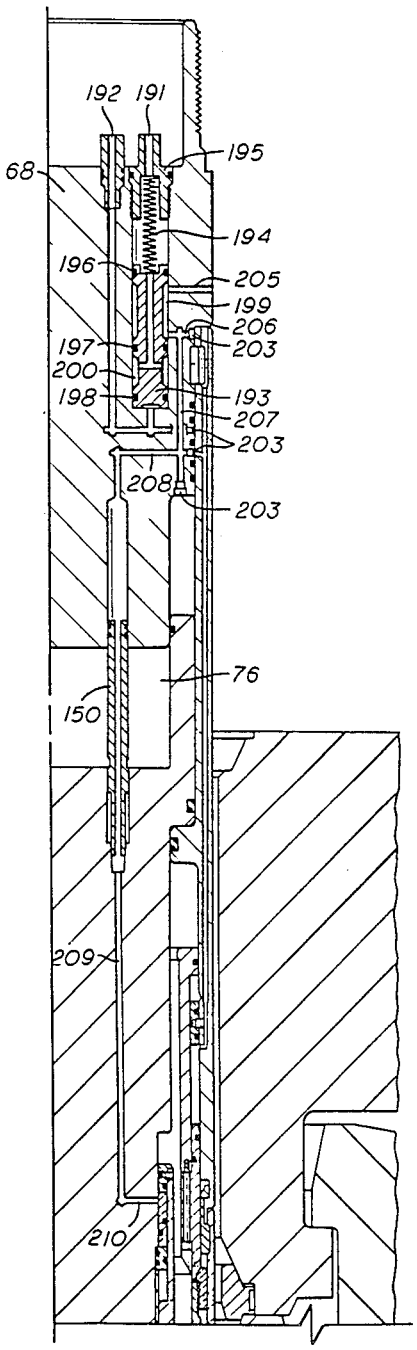
FIGS. 15A and 15B each is a split longitudinal sectional view of the running tool of the present invention with the detail through the shuttle valve in its opened (FIG. 15A) and closed (FIG. 15B) position.
Figure 15B:
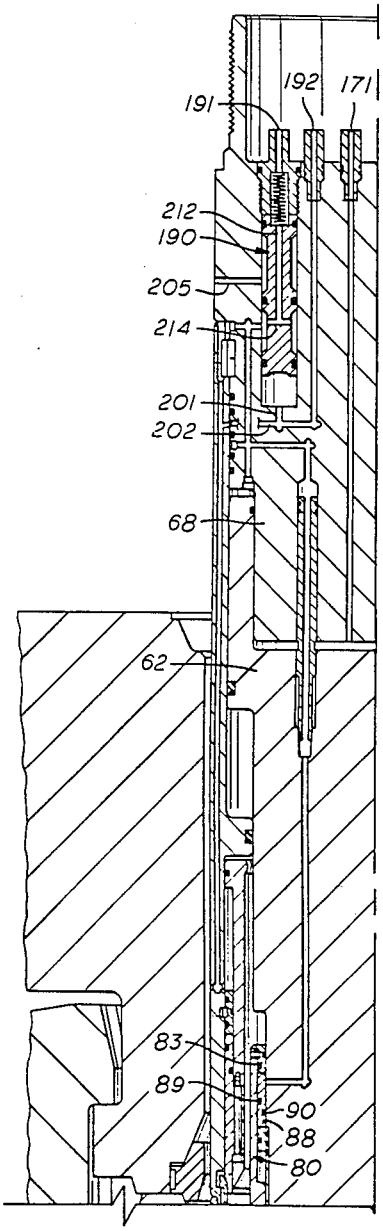

Referring to FIGS. 15A and 15B, a shuttle valve assembly 190 is illustrated in its "down" and "up" positions, respectively, which comprises a mechanism for emergency release of the running tool 60 from the tubing hanger assembly 30. Shuttle valve assembly 190 includes lines 191 and 192. The shuttle valve assembly 190 also includes a spool valve 193, a spring 194 and a nipple 195, all within line 191, in the upper portion 68 of the running tool 60. The spool valve 193 has three annular seals 196, 197 and 198 around the upper, intermediate, and lower portions of the spool valve body, respectively. On the outside surface of the spool valve 193, between seals 196 and 197, is a circumferential groove 199, and between seals 197 and 198 is a circumferential groove 200. Line 191, which has a larger diameter than line 192 to accommodate the spool valve 193 and spring 194, terminates in a smaller diameter line 201. A radial line 202 connects line 201 with line 192. Certain of the lines radial and axial, are capped with caps 203. Hence, fluid can be injected into line 192 such that the fluid will pass through lines 202 and 201 into line 191, acting upon the bottom of spool valve 193 to move the spool valve 193 to the "up" position and compress spring 194 (FIG. 15B). During normal running operations, pressure is maintained in line 192 and the spool valve 193 is maintained in its "up" position.

The purpose of the shuttle valve assembly 190 is to make certain that the running tool 60 can be disengaged from the tubing hanger assembly 30 in the event the hydraulic system fails, or if there is a failure in line 142 (see FIG. 9B) which is normally used for disengaging the running tool 60. In the event of hydraulic system failure, the shuttle valve assembly 190 will assume the configuration illustrated in FIG. 15A. With loss of pressure in line 192, the spool valve 193 is forced downward by spring 184. A radial line 205 extending from the outer surface of upper body 68 is in fluid communication with groove 199. Also in fluid communication with the groove 199 is another radial line 206 capped with cap 203, an axially extending line 207 also capped with a cap 203, another radial line 208 capped with a cap 203, and then another axially extending line 209. Line 209 has a portion in the upper body 68, and the other portion in body 62, interconnected by a connector 150. Line 209 extends into body 62 to a radial line 210. Radial line 210 is in fluid communication with the upper piston chamber of the tubing hanger latching assembly 80. That is, the radial line 210 is above seals 89 and 90 of annular piston 88, but below the seals on the upper portion 83. Thus, shuttle valve assembly 190 provides an auxiliary override or a second fluid communication means to the upper piston chamber of the tubing hanger latching assembly for raising upper portion 83 of the tubing hanger latching assembly 80 and releasing the running tool from the tubing hanger assembly. Hence, when the hydraulic system fails, fluid can be injected through the annulus of the well and into the system comprising line 205, groove 199, and lines 206, 207, 208, 209, and 210 to the upper piston chamber of the tubing hanger latching assembly 80 to raise upper portion 83 and still disconnect the running tool 60 from the tubing hanger assembly 30.

In the event there is a failure in line 142 with the remainder of the hydraulic system still intact, a second alternative is to inject fluid into line 191 (see FIG. 15B) while maintaining the fluid in line 192 and, therefore, the spool valve 193 in its "up" position. The spool valve 193 has a central bore 212 which terminates in a radial port 214 in communication with groove 200. With the shuttle valve 193 in its "up" position, fluid can be injected into line 191, through opening 212 and line 214, into the groove 200, and therefore into the lines 206, 207, 208, 209 and 210 to provide an upward thrust to the upper portion 83 of the tubing hanger latching assembly 80 for disassembly of the running tool 60 from the tubing hanger assembly 30. Hence, the shuttle valve assembly 190 is an override and emergency system to make certain that once the tubing hanger assembly 30 is positioned, the running tool can be disengaged from the tubing hanger assembly and removed from the well.

To illustrate the unique advantages of the present invention, some of the steps in the assembly and operation of the tubing hanger assembly 30 and the running tool 60 are set forth below. Prior to lowering the present invention into the well, by utilizing tools known to those skilled in the art, a lead impression block can be lowered within the wellhead and landed on the top of the last or uppermost casing hanger body to determine the relative elevation from the top of the casing hanger assembly 20 of the locking groove 14 in the housing 10. Thus, the proper thickness of shims to be utilized in the load ring 32 can be determined in order to ensure that when the tubing hanger is properly seated on the casing hanger, ring 36 will be adjacent to groove 14. With this measurement, the final adjustments can be made to the tubing hanger assembly 30 for preparation to be run into the well bore.

When all the operations, well known to those skilled in the art, for setting the casing and casing hangers have taken place, the running and hanging of the tubing string as a single continuous operation can be commenced. The tubing string is run into the well bore. The tubing hanger assembly 30 is connected to the tubing string at the appropriate pipe joint. The tubing string pipe joint to be connected to the tubing hanger assembly 30 is threadedly connected to the bottom of the hanger as is illustrated by the case of the five-inch string in the attached drawings. The packoff assembly 40 is checked and the release sleeve 51 is shear-pinned (not shown) to the packoff sleeve 41 in the relative axial positions shown in FIGS. 1A and 1B. This is to prevent relative axial movement between sleeves 41, 51 as the packoff assembly 40 is carried into the well. The dogs 49 are checked to make certain they are free to move radially inwardly, and fully greased. The seal 45 is properly attached to the lower portion of the packoff sleeve 41. The complete packoff assembly 40 is greased and then lowered over the top of the tubing hanger assembly 30. The packoff assembly 40 is permitted to be lowered over the tubing hanger assembly 30 until the expansion ring 38 is visible through the openings 44 of the packoff sleeve 41. With the packoff assembly 40 in position, the assembled running tool 60 has its hydraulic system attached and pressured by flow of fluid into the following lines:

a. Line 142—which places the tubing hanger latching assembly 80 of the running tool 60 in the "up" or raised and unlocked position.
b. Line 164—to place the seal-latching assembly 100 in the raised and unlocked position.
c. Line 178—to place the upper portion 68 of the running tool 60 in the "up" position relative to the body 62 of running tool 60.
d. Line 192—to keep spool valve 193 in the "up" position.

The running tool 60 is lowered for connection to the tubing hanger assembly 30 and the packoff assembly 40. As is known to those skilled in the art, when the tubing strings are parallel and side-by-side, orientation is required. On the other hand, if the strings are concentric, no orientation is required. The stab subs and orientation pins of the running tool 60 are aligned with the mating structure of the tubing assembly 30, and the running tool 60 is lowered until it rests on top of the tubing hanger assembly 30.

Thereafter, the hydraulic pressure to line 142 is released and pressure is applied to line 140. This causes the movable sleeve 82 to move downward. The ram surface end 91 of the movable sleeve 82 engages the locking ring 92 so that it moves radially outwardly into groove 39 in the upper portion of the tubing hanger 31. By maintaining the pressure to line 140, the tubing hanger latching assembly 80 is latched to the tubing hanger assembly 30. The hydraulic pressure to line 164 is released, and pressure is applied in line 160. This causes the lower body 104 to move downward and engage the locking ring 109 to force it radially inward into groove 55 of the packoff assembly 40. The lower end of the surrounding sleeve 66 bears on top of the release sleeve 51. The pressure in line 160 is maintained. At the same time the pressure is initiated in lines 178 and line 192 to complete the attachment of the running tool 60 to the tubing hanger assembly 30.

The assembled tools are then pressure tested to test the tubing and the annulus bores of the tubing hanger assembly 30, the control lines, the test lines and other functional hydraulic lines to the running tool 60. Pressure may also be applied to line 144 to test all the connections between the running tool 60 and the tubing hanger assembly 30. Successful testing indicates that the entire assembled structure is ready to be lowered into the well bore.

As illustrated, the presence of parallel, side-by-side tubing strings requires orientation of the assembled structure in the well bore. Such orienting means as helical cam sections are well known in the art. Since there are several well known alternatives for orienting the structure lowered into the well, the details thereof are not shown herein. The joints of running string are now connected to the running tool for lowering the running tool 60 into the well bore. The hydraulic control lines are bundled in the running string, as is known in the art. The running string joints are added until the tubing hanger is within a short distance from landing on the casing hanger 20. As is also known in the art, a blowout preventer is utilized so that there is a blowout preventer control system both for supporting the running tool and for containing the pressure of fluid within the annulus. A conventional blowout preventer (BOP) of the bag-type may be used. It is conventional that through one of the side outlets of the blowout preventer stack, pressure from the BOP control system will actuate the orientation pin on the BOP stack (for engaging a helical orienting surface in the upper part of the running tool, for example). Once orientation is accomplished, then the tubing hanger assembly 30 can be landed on the casing hanger body 20 which is already in the housing 10. The landing of the tubing hanger assembly 30 onto the casing hanger body 20 sets seal 34. Thereafter, the blowout preventer is closed and hydraulic pressure is applied through the choke and kill lines to test the seal 34 from above by monitoring the annulus line of the tubing hanger assembly 30 for leakage. Upon successful testing, the blowout preventer is opened. If a successful test of seal 34 is not accomplished, then no further operations would be carried out at that time. Instead, the running tool would be pulled to replace the seal 34. Upon a successful setting and testing of seal 34, the operations continue.

Thereafter, the pressure to line 178 is released and hydraulic pressure is applied to line 170. This causes surrounding sleeve 66 to move downwardly, and the seal latching assembly 100 and the packoff assembly 40 to move downwardly along with it. The nose portion 46 of packoff sleeve 41 engages the split lock ring 36 to cam it outwardly into the mating groove 14 of housing 10. Upon the downward movement of seal 45, it is energized between the inner diameter of the housing 10 and the outer surface of tubing hanger 31. The packoff assembly 40 moves down until the expansion ring 38, housed within the groove 37 at the upper end of tubing hanger 31, is adjacent to and expands into the groove formed by shoulder 56 in the packoff sleeve 41. When the expansion ring 38 so expands, this locks the packoff assembly 40 to the tubing hanger assembly 30. The completion of the downward movement wherein the foregoing locking of the seal assembly occurs is indicated by the internal cam surface 103' of the seal latching assembly 100 camming the probe 134 of the hydraulic indicator 132 inwardly. Hydraulic pressure is applied to line 131, and the detection of that pressure returning in line 130 indicates that the downward positioning has been completed sufficiently that packoff assembly 40 is in the set position. An advantage of the hydraulic indicator 132 is that an actual physical indication is confirmed when the cam surface 103' of the seal latching assembly 100 has passed a definite point on the lower body 62 of the running tool 60.

With the seal 45 now set, the blowout preventer is closed for testing the integrity of seal 45. Pressure is applied through the choke and kill lines to test the seal 45 from above. Leakage is monitored through test port line 114. Upon successful testing, the blowout preventer is opened to continue testing the seal 34. The seal 34 may be tested from below by applying pressure through the annulus and monitoring the leakage through test port line 114. Furthermore, pressure may be applied through test port line 114 to retest seal 34 from above and to test seal 45 from below. Any leakage is monitored in the annulus. By the foregoing, the tubing hanger assembly 30 has been positioned in the casing 20 with two seals, namely seal 34 and seal 45, having been set and tested from above and below before the running tool 60 has been disengaged. Furthermore, downhole work may be performed and further steps taken in preparation for production while still maintaining engagement of the running tool with the tubing hanger assembly 30.

To release the running tool 60, the hydraulic pressure to line 160 is released and pressure is applied to line 164. This causes the lower body 104 to move upwardly and release locking ring 109 so that it may disengage from groove 55 of the packoff assembly 40. Pressure on line 164 is maintained. Further, the hydraulic pressure to line 140 is released and pressure is applied to line 142. This causes the movable sleeve 82 to move upwardly and the ram surface end 91 of the movable sleeve 82 to disengage from the locking ring 92, permitting it to be cammed inwardly and out of the groove 39 in the upper portion of the tubing hanger 31. Hydraulic pressure in line 142 is maintained. The running tool 60 has now been disengaged so that by releasing any orientation structure through the BOP control system, the running string and the running tool 60 can be lifted and withdrawn from the well.

When it is desired to remove the packoff assembly 40 from the well without removing the tubing hanger 31, an appropriate tool, for example running tool 60, can be run into the well and attached to the upper portion of release sleeve 51, for example at groove 55. When the release sleeve 51 is lifted upwardly, ramp surface 52 cams dogs 49 inwardly, in turn forcing ring 38 inwardly and out of the groove of shoulder 56 on packoff sleeve 41. Packoff assembly 40 is thereby released from tubing hanger 31. Further lifting of release sleeve 51 carries the entire packoff assembly 40 upwardly along with it, since there is a travel stop member 250 threadedly engaged around the upper end of packoff sleeve 41 (FIG. 1B), which has a downwardly facing shoulder 252 for engaging an opposing, upwardly facing shoulder 254 on release sleeve 51. In other words, release sleeve 51 is connected to packoff sleeve 41 by means of a "lost motion" connection. In order to reduce the drag of ring 38 on shoulder 56 as it is being retracted into groove 37 of tubing hanger 31, fluid pressure can be applied to chamber 106. This tends to force body 104 downwardly, and in turn tends to force member 250 and/or packoff sleeve 41, with which it is in contact, downwardly as well. Fluid pressure in chamber 106 also acts on surface 101', tending to force sleeve 66 upwardly. This upward force is transmitted to release sleeve 51 through ring 109 engaged in groove 55 of release sleeve 51. Fluid pressure is then applied to chamber 180, which acts on surface 184 and tends to force upper body 68 and surrounding sleeve 66 upwardly. As a result, a net upward force acts on sleeve 51, while a net downward force acts on sleeve 41. The net upward force on sleeve 51 should be sufficient to shear any shear pins (not shown) between sleeves 41, 51 which otherwise prevent relative axial movement therebetween. With packoff assembly 40 removed from the well, seal 45 can be examined and replaced, if necessary, with another seal assembly or with a completely new packoff assembly.

Because many different and varying embodiments of the present invention may be made within the scope of the inventor's concept taught herein, and because many modifications may be made in the embodiments herein detailed in accordance with the descriptive requirements of the law, it should be understood that the details herein are to be considered as illustrative, and not as limiting. Thus, it should be understood that the invention is not restricted to the illustrated and described embodiment, but can be modified by one of ordinary skill in the art within the scope of the following claims.

I claim:

1. A running tool for running a tubing hanger and packoff assembly into a subsea wellhead housing and setting the packoff assembly between the tubing hanger and wellhead housing, comprising:

an upper member having an upper generally tubular cyclindrical body with a reduced diameter portion at its lower end, and a downwardly extending surrounding sleeve disposed on said body around said reduced diameter portion and extending beyond the lower end of said body, there being an annular space between said reduced diameter portion and said surrounding sleeve;

a lower member having a lower generally tubular cylindrical body with an upper end portion telescopingly received in said annular space and a lower body portion;

said lower body portion having an upper portion having a large outer diameter surface, said large outer diameter surface being reduced in outer diameter from said upper end portion, said lower body portion having an intermediate portion having an intermediate outer diameter surface positioned below said large outer diameter surface and having a further reduced outer diameter surface, and said lower body portion having a lower third portion having a lower small outer diameter surface positioned below said intermediate outer diameter surface and having a smaller outer diameter than said intermediate outer diameter, said lower member being substantially entirely received in said surrounding sleeve of said upper member;

packoff setting means disposed on said member for moving said upper body and surrounding sleeve downward with respect to said lower body for engaging and setting the packoff assembly;

packoff latching means slidably mounted on said surrounding sleeve, between said surrounding sleeve and said lower body portion, for releasably attaching said surrounding sleeve to the packoff assembly;

a tubular member threadedly engaged with a portion of said lower outer small diameter surface of said lower third portion of said lower body portion of said lower member, and positioned about and in contact with said lower outer small diameter surface, and partially surrounded by slidable tubing hanger latching means, said slidable tubing hanger latching means being slidably mounted on said intermediate outer diameter surface, and being positioned about a portion of said lower third portion, between said lower small outer diameter surface and said packoff latching means, for releasably attaching said lower small outer diameter surface and said tubular member to the tubing hanger;

hydraulic system means connected to said packoff setting means, with said packoff latching means and said tubing hanger latching means being used for actuating the packoff setting means, and for moving the packoff latching means and the tubing hanger latching means into and out of attachment with the packoff assembly and the tubing hanger, respectively.

2. A running tool according to claim 1, wherein said packoff setting means includes a piston sleeve within said surrounding sleeve, said piston sleeve having an annular piston surface disposed on the internal bore of said surrounding sleeve and a cylindrical piston surface sealingly slidable against said upper large outer diameter surface of said lower body portion of said lower member, and a piston chamber defined between said annular piston surface and the upper end portion of said lower member.

3. A running tool according to claim 2, wherein said packoff latching means includes a fixed ring sealingly attached to the internal bore of said surrounding sleeve below the annular piston surface of said piston sleeve, a movable packoff latch sleeve having a piston on its upper end and a piston on its lower end, the upper piston end being disposed between said fixed ring and said annular piston surface and sealingly slidable on the internal bore of said surrounding sleeve, said packoff latch sleeve extending below said fixed ring and being sealingly slidable against said fixed ring, and said lower piston end disposed below said fixed ring and sealing slidable on the internal bore of said surrounding sleeve, said surrounding sleeve having a radially movable latch ring thereon for releasably connecting to said packoff assembly, and said lower piston end having latch ring engagement means thereon for alternatively engaging said latch ring and maintaining its connection to said packoff assembly or disengaging from said latch ring and permitting its release from said packoff assembly.

4. A running tool according to claim 3, wherein said tubing hanger latching means includes a second fixed ring sealing mounted on said small outer diameter surface of said lower body portion, a movable tubing hanger latch sleeve having an upper piston and a lower piston, said upper piston end of said tubing hanger latching means being disposed above said second fixed ring and sealingly slidable on said intermediate outer diameter surface of said lower body portion, said tubing hanger latch sleeve extending below said second fixed ring and being sealingly slidable against said second fixed ring, said lower piston end being disposed below said second fixed ring and sealingly slidable on said small outer diameter surface of said lower body portion, and a movable piston between said second fixed ring and said upper piston end of said tubing hanger latch sleeve and sealingly slidable on the interior wall of the tubing hanger latch sleeve and the small outer diameter surface of the body, the lower end of said small outer diameter surface having a radially movable lock ring thereon for releasably locking to said tubing hanger, and said lower piston end of said tubing hanger latch sleeve having lock ring engagement means thereon for alternatively engaging said lock ring and maintaining its engagement with the tubing hanger or disengaging from said lock ring and permitting its release from said tubing hanger.

5. A running tool according to claim 3, and further including hydraulic indicator means disposed in said lower member body and extending radially outwardly therefrom for detecting sufficient downward axial movement of said packoff latch sleeve to ensure that the packoff assembly has been set.

6. A running tool according to claim 5, wherein said hydraulic indicator means includes a probe extending into an annulus between the upper large outer diameter surface of said lower body portion and said packoff latch sleeve for engaging the upper piston end of said packoff latch sleeve upon the occurrence of such sufficient downward axial movement of said surrounding sleeve and said packoff latch sleeve, said packoff latch sleeve and said surrounding sleeve being adapted for concurrent and substantially equal downward axial movement when said packoff setting means is actuated.

7. A running tool according to claim 4, and further including emergency tubing hanger release means for releasing said tubing hanger latching means from said tubing hanger in the event of failure of said hydraulic system means, said hydraulic system means routinely being used for moving the tubing hanger latching means out of engagement with the tubing hanger.

* * * * *